US008225973B1

(12) United States Patent
Bellinson

(10) Patent No.: US 8,225,973 B1
(45) Date of Patent: Jul. 24, 2012

(54) USER-SUPPORTED MULTIPLE POUCH DEVICE

(76) Inventor: Susan G. Bellinson, City Island, NY (US)

( * ) Notice: Subject to any disclaimer, the term of this patent is extended or adjusted under 35 U.S.C. 154(b) by 1091 days.

(21) Appl. No.: 11/799,982

(22) Filed: May 3, 2007

Related U.S. Application Data

(60) Provisional application No. 60/797,026, filed on May 3, 2006.

(51) Int. Cl.
*A45F 3/02* (2006.01)

(52) U.S. Cl. ..... 224/602; 224/603; 224/257; 224/258

(58) Field of Classification Search ..... 224/600, 224/603, 605, 608, 610, 616, 617, 618, 257, 224/258, 623, 587, 647, 683, 684, 602
See application file for complete search history.

(56) References Cited

U.S. PATENT DOCUMENTS

| | | | | | |
|---|---|---|---|---|---|
| D261,196 | S | * | 10/1981 | Griffin | D3/224 |
| 4,350,274 | A | * | 9/1982 | Morgan | 224/610 |
| 4,449,654 | A | * | 5/1984 | Cappis | 224/148.6 |
| 4,722,464 | A | | 2/1988 | Wright | |
| 4,826,060 | A | * | 5/1989 | Hollingsworth | 224/613 |
| D315,640 | S | * | 3/1991 | Pelzel | D3/230 |
| 5,150,824 | A | * | 9/1992 | Alvarez et al. | 224/586 |
| 5,263,618 | A | | 11/1993 | Talavera | |
| 5,318,084 | A | * | 6/1994 | Jackson | 150/109 |
| 5,639,005 | A | | 6/1997 | Chouinard | |
| D387,901 | S | | 12/1997 | Ellis et al. | |
| 5,718,364 | A | | 2/1998 | McDowell | |
| 5,957,354 | A | * | 9/1999 | Mentken | 224/614 |
| 5,967,390 | A | * | 10/1999 | Goryl | 224/153 |
| 6,209,769 | B1 | * | 4/2001 | Seals et al. | 224/583 |
| 6,311,336 | B1 | * | 11/2001 | Gootrad | 2/251 |
| 6,543,661 | B1 | | 4/2003 | Lazur | |
| 6,568,575 | B1 | | 5/2003 | Bartholomew | |
| 6,644,527 | B1 | | 11/2003 | Karenga | |
| D505,787 | S | | 6/2005 | Vaughn | |
| D600,442 | S | * | 9/2009 | Shepard | D3/224 |
| 2006/0157525 | A1 | * | 7/2006 | Furlong et al. | 224/601 |
| 2010/0025447 | A1 | * | 2/2010 | Smart | 224/682 |

* cited by examiner

*Primary Examiner* — Justin Larson
(74) *Attorney, Agent, or Firm* — Montgomery Patent & Design, LLC; Robert C. Montgomery; Joseph Yaksich

(57) ABSTRACT

The invention as presently conceived discloses a personal garment apparatus resembling a holster-like shoulder bag that is worn over a person's shoulder having a plurality of pouches and pockets to store and transport various articles. The presently defined preferred embodiment consists of: three front pockets for a cell phone, a palm pilot, a USB key, a MP3 player, money clip, etc.; another larger zipper pocket situated behind the flap pockets to hold flat items like a checkbook, a passport, tickets, etc.; an adjustable strap to customize the shoulder fit for most people; and, a set of attachment clips allowing the invention to be reversed for wear on either shoulder. Besides being a new fashion accessory, the invention's functionalities are intended to provide easier access and increased comfort when compared to similar items being carried on a belt, about the waist or in pockets.

18 Claims, 4 Drawing Sheets

USER-SUPPORTED MULTIPLE POUCH DEVICE

RELATED APPLICATIONS

The present invention was first described in and claims the benefit of U.S. Provisional Application No. 60/797,026, filed May 3, 2006, the entire disclosures of which are incorporated herein by reference.

FIELD OF THE INVENTION

The present invention relates generally to a personal garment apparatus resembling a holster-like shoulder bag preferably worn over a person's shoulder and more particularly, to said garment having a plurality of pouches and pockets to store and transport various personal articles thus serving as an alternative to the belted waist pouch.

BACKGROUND OF THE INVENTION

In recent years people have taken to wearing a belted pouch around their waists in order to carry personal items, money, keys, cellular telephones and similar personal articles. This waist pouch article of clothing has come to be known as a "fanny pack." The belted pouches are particularly popular with individuals such as joggers, bicycle riders, walkers and others who may not have on appropriate pants or skirts with pockets. These same problems also exist in some degree with other items such as MP3 players and similar electronic devices that are required to be carried on the person.

Several attempts have been made in the past to design pouches that allow a user to conveniently carry personal items without adding excessive weight or bulk to the person. U.S. Pat. No. 6,644,527 in the name of Karenga discloses a strap pack carrier which can be worn as a sash. The strap pack carriers form a loop adapted to stably conform to the body of the wearer to provide easy access pouches up in front of the body. Counter weights can be mounted to help stabilize the carrier against unequal front to back loads of articles. Unfortunately, this prior art example may create excessive bulk near a user's waist, making it difficult for a user to move freely.

U.S. Pat. No. 5,263,618 in the name of Talayera discloses a universal carrier comprised of a pocket holding support and a harness for attachment to the body of a person carrying objects on the support. The support has an outwardly facing surface whereon various sized article holding pockets can be secured. A strap like extension extends from the support and is attached to a vertical strap on the harness. Article holding pockets are secured to the outwardly facing surface on the support, and at least one water bottle carrying pocket is secured to the vertical strap on the harness. The water bottle is attached at a proper level and has a flexible tube extending out from its mouth enabling a person engaged in an activity requiring the use of both hands to move his head so the end of the tube can enter his mouth permitting the person to get a drink without using his hands. Unfortunately, this prior art example is designed to carry excessive equipment associated with certain hobbies and does not provide any benefit to a user for everyday use.

U.S. Pat. No. 6,543,661 in the name of Lazur describes a shoulder harness apparatus for carrying personal items on an upper body portion of a user. The shoulder harness apparatus includes a main harness member designed to be worn over the shoulders of a user, and a plurality of detachable holders and sleeves for carrying personal items. Unfortunately, this prior art example creates excessive strain on the shoulder and therefore can not be worn by users with shoulder or back problems.

U.S. Pat. No. 6,568,575 in the name of Bartholomew discloses a harness with detachable and interchangeable pouches comprised of two torso straps extending downwardly and outwardly from a central coupler assembly, two shoulder straps, and two belly straps. The harness is adjustable to fit nearly any body size. The pouches are attached to the harness with quick-releasing retaining clips and to each other by the belly straps. Each pouch includes front and rear panels that are formed using either a right-side template or a left-side template and is interchangeable with any other pouch designed using the same template. The interchangeability allows the wearer to install pouches that are best suited for a particular activity. Each pouch is designed such that, when worn, it hangs at an angle which causes its top to slant downwardly toward the middle of the wearer's torso, thereby increasing the accessibility of the pouch contents. Unfortunately, this prior art example may create excessive bulk near a user's waist, making it difficult for a user to move freely.

None of the prior art particularly describes a user-supported multiple pouch device designed to be worn across the chest of a user. Accordingly, there exists a need for a means by which personal items and electronic devices can be more easily carried and accessed and used in a mobile environment that is fashion conscious.

SUMMARY OF THE INVENTION

In view of the foregoing disadvantages inherent in the prior art, it has been observed that there is need for an apparatus to carry personal items and electronic devices while allowing easy access and use in a mobile environment that is fashion conscious.

The invention as presently conceived discloses a personal garment apparatus resembling a holster-like shoulder bag that is worn over a person's shoulder having a plurality of pouches, pockets and compartments to store and transport various personal items. The presently defined preferred embodiment consists of: front pockets for a cell phone, a PDA, a USB key, a MP3 player, money clip, etc.; a larger zipper pocket situated behind the flap pockets to hold flat items like a checkbook, a passport, tickets, etc.; an adjustable strap to customize the shoulder fit for most people; and, a set of attachment clips allowing the invention to be reversed for wear on either shoulder. A zipper on one (1) side or both sides allows access to a secure inner compartment that is behind the front-facing pockets and accessible from either side. The configuration of the garment allows it to be worn and used equally by right-handers and left-handers. Besides being a new fashion accessory, the invention's functionalities are intended to provide easier access, increased comfort and also as a new version for the traditional belted pouch that is worn about the waist known as "fanny packs." The use of the present apparatus allows ease of access to personal carry items for the active person in a manner that is efficient and stylish.

In particular, the present invention includes a carrying case for storing and transporting objects. Such a carrying case includes a zippered pocket. Such a pocket includes a storage chamber located along an internal back face of the carrying case. The pocket includes a first zipper and a second zipper oppositely seated therefrom for allowing access to an interior portion of the pocket, and a plurality of pouches are attached to an outward facing surface of the pocket. Such first and second zippers are provided along opposing upper and lower edges of the pocket such that the pocket is advantageously accessible from the upper and lower edges thereof. The pocket further includes an frictional material situated along an inner surface thereof and engageable with a body of the user.

The device further includes a plurality of pouches attached to the pocket. Such pouches include a corresponding flap pivotally attached thereto. The pouches protrude outwardly along an external front face of the pocket, wherein a corresponding length of each of the pouches extends across an entire span of the pocket. Each of the pouches further includes a first magnetic fastener and a second magnetic fastener removably connected thereto. The flaps are monolithically formed with an upper sewn panel of the pouches, and the second magnetic fastener is mounted within a central location along an outward panel of the pouch and oriented in a position corresponding to the first magnetic fastener located at a central location within an internal face of the flaps.

The device further includes a shoulder strap monolithically formed with the pocket. Such a shoulder strap is permanently connected along a top edge of the pocket via a pivot ring, wherein the shoulder strap extends from the pocket and around a user torso, the shoulder strap is removably attachable to the bolt snap fastener and the attachment rings respectively. The pivot ring allows the shoulder strap to travel back and forth withn the ring to eliminate rigidity of a supporting angle and increase comfort. The shoulder strap further includes an adjustment clip attached to a portion thereof, and an adjustable loop portion of the shoulder strap is positional through the clip. A plurality of strap pads is attached to the shoulder strap, and a metal bolt snap is coupled to a distal end of the shoulder strap.

The device further includes a bolt snap fastener directly coupled to the shoulder strap, and a plurality of attachment rings is directly coupled to the pocket and removably attached to the bolt snap fastener. Such attachment rings are attached to opposing corners of the pocket.

Another embodiment of the device provides for a plurality of pouches of waterproof and resilient material attached to the pocket. The pouches protrude outwardly along an external front face of the pocket, wherein a corresponding length of each of the pouches extends across an entire span of the pocket. Each of the pouches further includes a zippered fastener monolithically formed within an upper location horizontally along an outward panel of the pouch.

A method of transporting objects in a carrying case includes the step of: placing the carrying case over a shoulder of the user such that a section of a shoulder strap of the carrying case rests the shoulder and another section of the shoulder strap rests on an oppositely located hip portion of the user such that the carrying case diagonally extends across chest and back regions of the user, whereas the pivot ring enables the shoulder strap to rest comfortably on the user. The method further includes the steps of: adjusting the shoulder strap to a desired length by adapting an adjustment clip connected thereto; interlocking a bolt snap portion of the shoulder strap to an upward attachment ring portion; opening at least one flap of a plurality of pouches connected to the pocket by disengaging first and second magnetic fasteners; placing the objects in the pouches; closing the pouches by engaging the first and second magnetic fasteners; unzipping a pocket by adapting an upward facing zipper along a first path; placing additional ones of the objects in the pocket; and zipping the pocket by adapting the upward facing zipper along a second path traveling opposite to the first path.

The method further includes these steps of: supporting the carrying case in a different orientation about the user; removing the objects from at least one of the pouches and the pocket; and adjusting an adjustment clip and the shoulder strap to lengthen the shoulder strap to a desired length.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | user-supported multiple pouch device |
| 20 | pouch |
| 21 | flap |
| 22 | inner pad |
| 23 | zippered pocket |
| 24 | first zipper |
| 25 | first magnetic fastener |
| 26 | second magnetic fastener |
| 28 | second zipper |
| 29 | pouch zipper |
| 30 | shoulder strap |
| 31 | strap pad |
| 32 | ring |
| 35 | adjustable loop |
| 40 | adjustment fitting |
| 50 | bolt snap |
| 51 | attachment ring |
| 60 | user |

DETAILED DESCRIPTION OF THE PREFERRED EMBODIMENT

Figure 1:
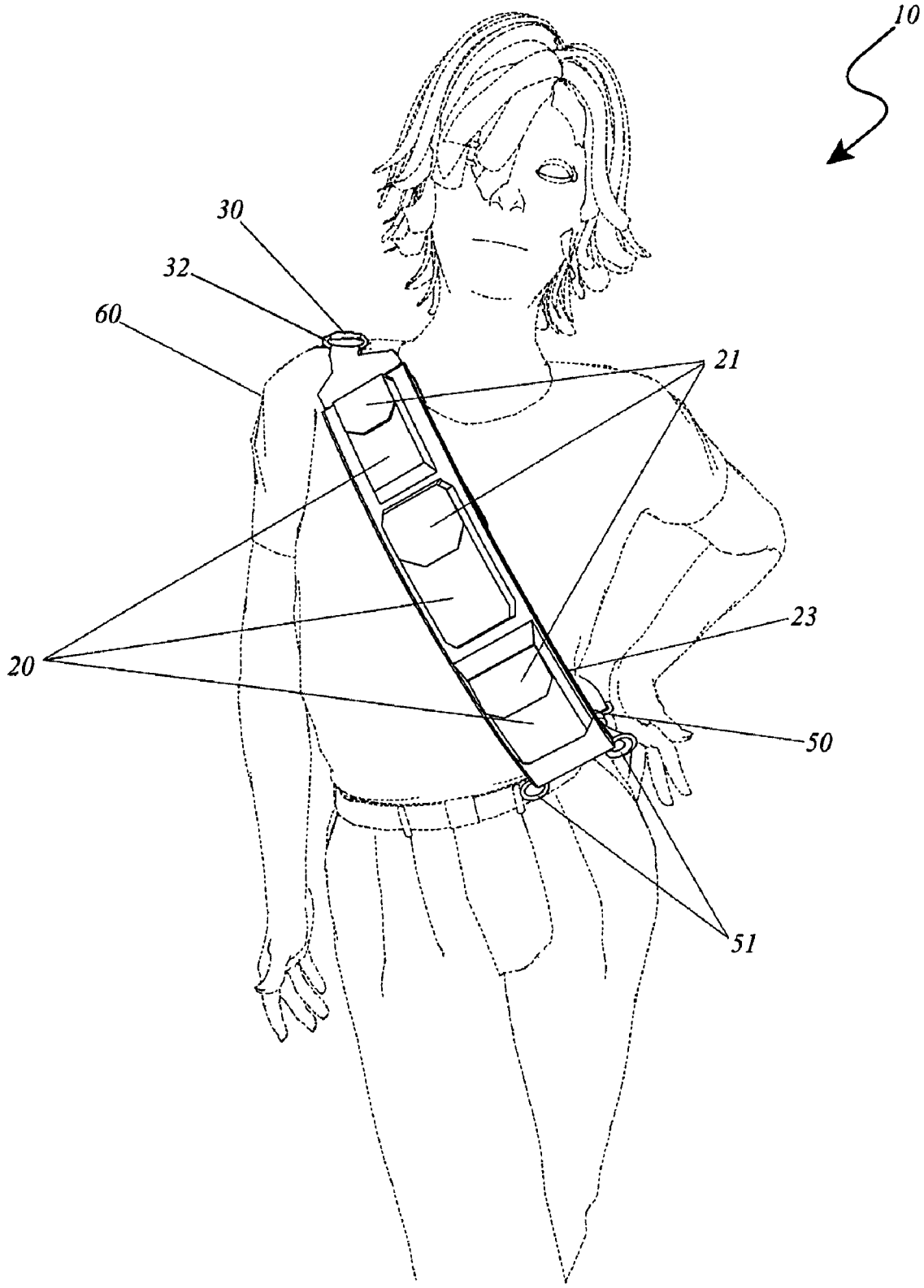
FIG. 1 is an environmental view of a user-supported multiple pouch device 10, according to a preferred embodiment of the present invention.
Figure 2A:
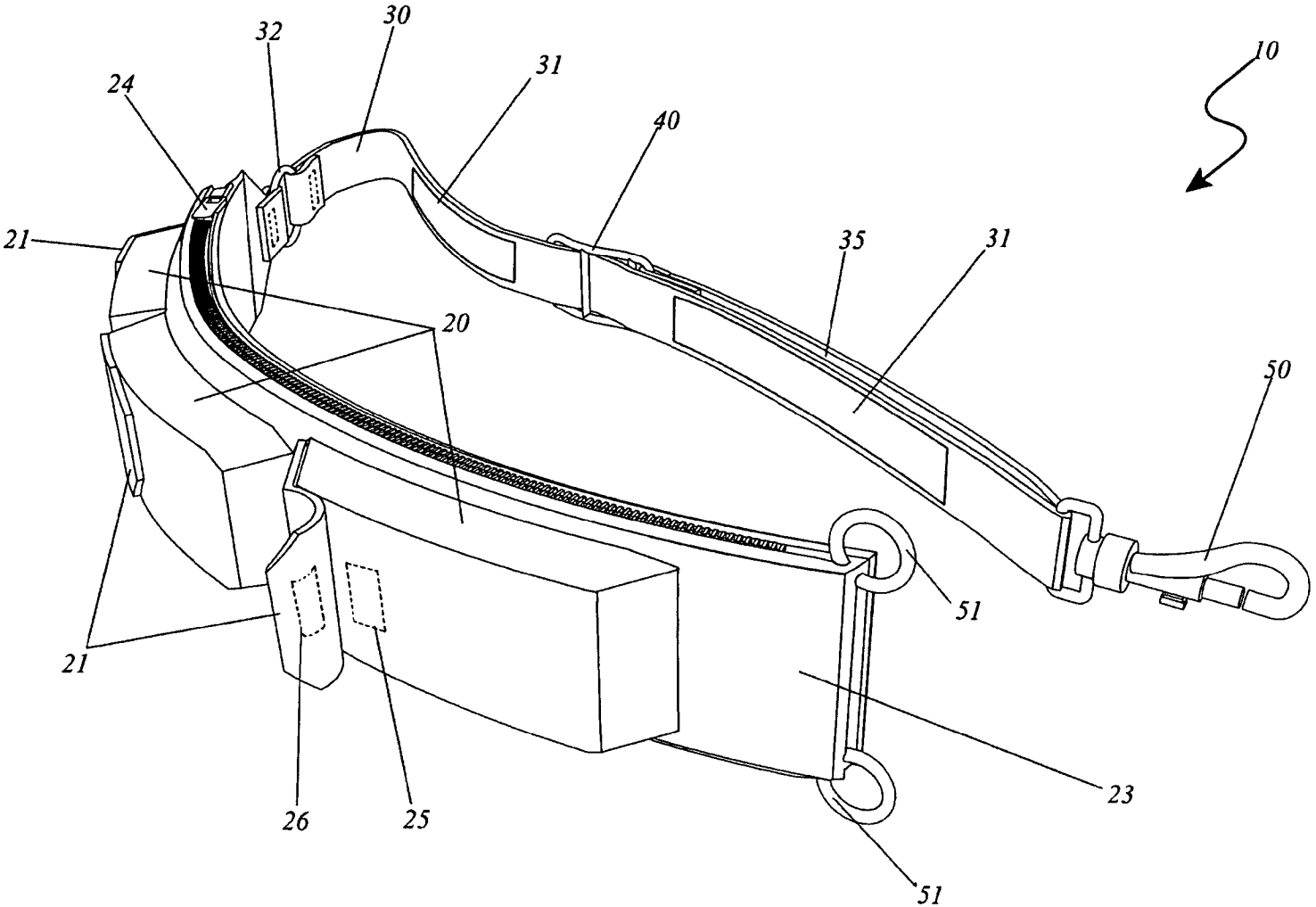
FIG. 2*a* is a front perspective view of a user-supported multiple pouch device 10, according to a preferred embodiment of the present invention; and, FIG. 2*b* is a rear perspective view of a user-supported multiple pouch device 10, according to a preferred embodiment of the present invention.
Figures 2B, 2C:
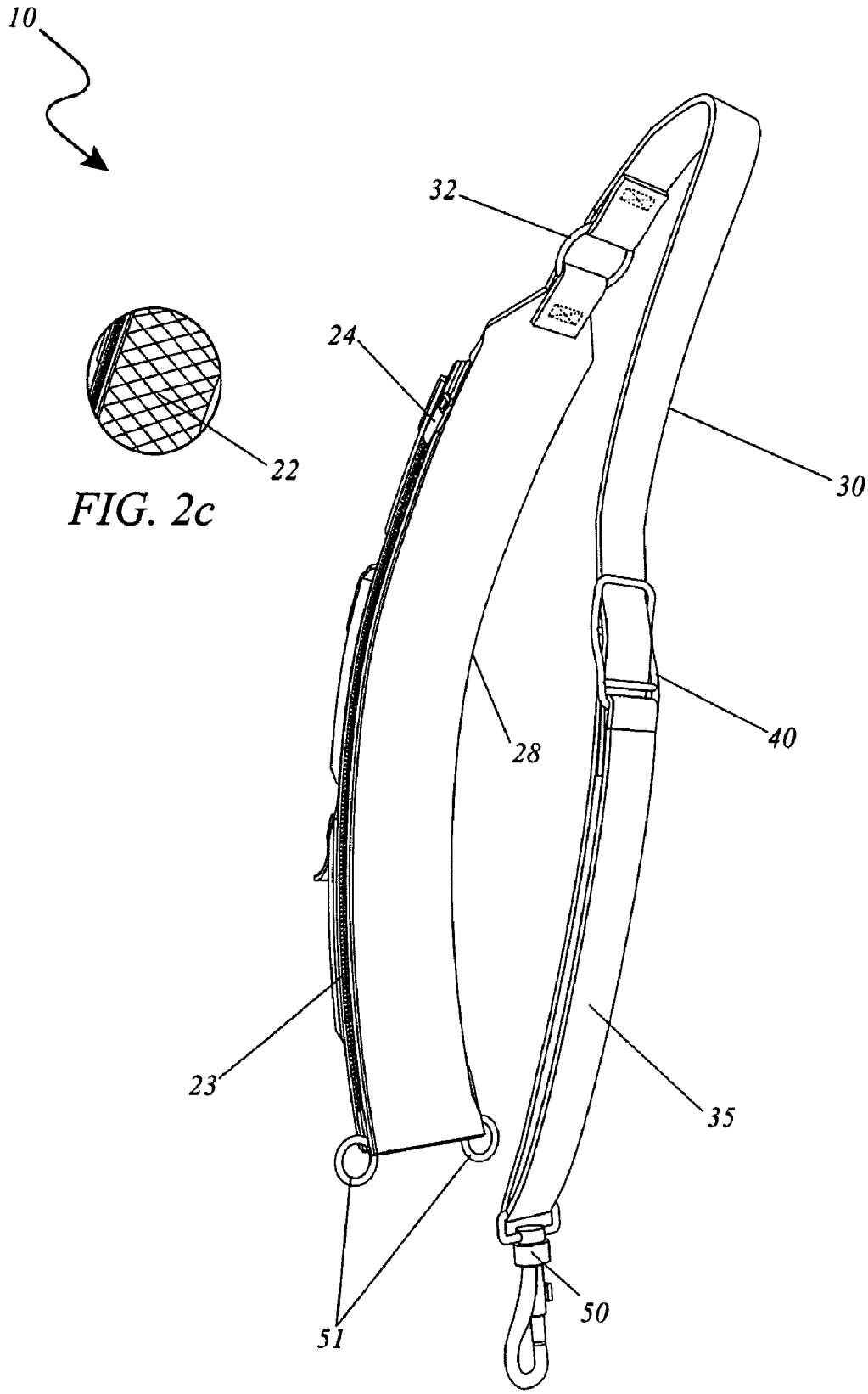
FIG. 2*c* is a rear perspective view of a user-supported multiple pouch device 10 depicting an inner pad material 22, according to an alternate embodiment of the present invention; and, FIG. 3 is a front perspective view of a user-supported multiple pouch device 10 depicting pouch zippers 29, according to an alternate embodiment of the present invention.

The best mode for carrying out the invention is presented in terms of its preferred embodiment, herein depicted within FIGS. 1 through 2*b*. However, the invention is not limited to the described embodiment and a person skilled in the art will appreciate that many other embodiments of the invention are possible without deviating from the basic concept of the invention, and that any such work around will also fall under scope of this invention (see FIG. 3). It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for a user-supported multiple pouch device (herein described as the "apparatus") 10, which provides a means for storing and transporting various personal articles within a personal garment apparatus resembling a holster-like shoulder bag that is worn over a person's shoulder. The apparatus 10 provides a plurality of pouches 20 and a large zippered pocket 23. The apparatus 10 is envisioned to be approximately eighteen (18) inches long and four (4) inches wide and comprises a convenient adjustment fitting 40.

Referring now to FIG. 1, an environmental view of the apparatus 10 according to the preferred embodiment of the present invention, is disclosed. The apparatus 10 comprises a large zippered pocket 23, three (3) pouches 20, three (3) flaps 21, a ring 32, a shoulder strap 30, a bolt snap 50, and two (2) attachment rings 51.

The large zippered pocket 23 comprises a storage chamber of approximately four (4) inches wide by approximately eighteen (18) inches long located along an internal back face of the apparatus 10 providing a storage means for various personal items such as a checkbook, a passport, airline tickets, and the like. The zippered pocket 23 comprises a first zipper 24 and a second zipper 28 allowing wide access to the interior portion of said zippered pocket 23 (see FIG. 2*b*). The zippered pocket 23 further provides an attachment means for a plurality of pouches 20 being attached thereupon an outward facing surface of the zippered pocket 23. The apparatus 10 is illustrated here in a preferred embodiment depicting three (3) pouches 20; however, any number of various sized pouches 20 may be provided and as such should not be interpreted as a limiting factor of the invention 10. The pouches 20 comprise various sized enclosures with flaps 21 suitable for carrying items such as a cell phone, a palm pilot, an MP3 player, a money clip, and the like. The pouches 20 are envisioned preferably being a multi-panel sewn assembly being securely sewn thereto and protruding outwardly along an external front face of the aforementioned zippered pocket 23; however, said pouches 20 may be attached to the zippered pocket 23 using various methods and materials such as hook-and-loop fasteners, adhesives, snaps, or the like, and as such should not be interpreted as a limiting factor of the present invention 10. The length of each pouch 20 may extend across the entire span of the zippered pocket 23 having similar or different widths. Additionally, a plurality of pouches 20 may be instituted with the same or different dimensions than one another. The zippered pocket 23 also provides an attachment means to an adjustable shoulder strap 30 (not shown) via a ring 32 connected jointly along a top edge of said zippered pocket 23 and said shoulder strap 30 via a permanently sewn connection. The ring 32 is envisioned as a circular fitting made using metal or plastic; however, said ring 32 may be provided in a variety of shapes such as a "D"-shape, oval, or the like. The shoulder strap 30 extends from said ring 32 connection, around the user's torso 60, and terminates in a removably attachable manner along a lower edge of said zippered pocket 23 via a bolt snap mechanism 50 and attachment rings 51.

The apparatus 10 is envisioned to be long and thin thereby limiting protrusions and preventing entanglement of apparatus 10 on other objects in proximity thereto. The apparatus 10 is envisioned to be introduced in stylish blends for all wardrobes and fashions for use by men and women. The apparatus 10 may also be introduced with a variety of aesthetically pleasing motifs and/or other images such as, but not limited to, cartoon characters, sport logos, and/or other caricatures. The apparatus 10 may also be introduced in a plurality of colors and designs and a variety of shapes and sizes with or without the option of it being fashioned to resemble effects such as, but not limited to, animals, characters, and/or other images. The pouches 20 may be introduced in a plurality of shapes such as, but not limited to, oval, heart, pear, square, triangle, polygon, rectangle, star, and/or other shapes capable of enclosing personal articles. Also, the apparatus 10 may be introduced with or without stitched writing for occasional occurrences such as, but not limited to, birthdays, anniversaries, Mother's Day, Father's Day, holidays, and/or other personal or impersonal embroidery.

Referring now to FIG. 2*a*, a front perspective view of the apparatus 10, according to the preferred embodiment of the present invention, is disclosed. The apparatus 10 comprises three (3) pouches 20, a shoulder strap 30, and a zippered pocket 23.

Each pouch 20 further comprises a flap 21, a first magnetic fastener 25, and a second magnetic fastener 26. The flap 21 is envisioned to be an extension of an upper sewn panel of the pouch 20. The pouch 20 and the flap 21 provide a secure enclosure to valuables contained within via the magnetic fasteners 25, 26. The magnetic fasteners 25, 26 are envisioned to be a sewn-in flat permanent magnet common in the industry. The magnetic fasteners 25, 26 are to be installed such that attracting polarities of each are facing one another, thereby providing a propensity to latch and secure the flap 21. The first magnetic fastener 25 is to be located at a central location along an outward panel of the pouch 20 in a position corresponding to a second magnetic fastener 26 located at a central location along an internal face of the flap 21.

The shoulder strap 30 further comprises an adjustment fitting 40, an adjustable loop 35, a plurality of strap pads 31, and a metal bolt snap 50. The shoulder strap 30 is envisioned being made using a durable strapping material such as nylon, textile, leather, or the like common in the industry. The shoulder strap 30 provides a stabilizing and conforming means thereto users 60 of various torso sizes and shapes. The shoulder strap 30 is threaded through and attached thereto an adjustment fitting 40 via a looped and sewn connection forming an adjustable loop 35 feature. The adjustment fitting 40 is illustrated here as a plastic ladder lock type buckle fixture; however, said adjustment fitting 40 may be provided in a variety of commercially available fixture styles and materials which provide similar adjusting functionality. The adjustable loop 35 provides a length adjusting means thereto the shoulder strap 30. The shoulder strap 30 is envisioned to provide a plurality of strap pads 31 affixed to a surface directed toward the user's body 60 using materials which provide added friction while increasing comfort such as, but not limited to air bladders, silicone gels, foam rubber panels, textured plastic, or the like. The shoulder strap 30 is to be threaded therethrough the adjustment fitting 40 forming an adjustable loop 35, thereby providing a snug fit of the apparatus 10 to users 60 torso. The adjustable loop 35 also provides an attachment means to a bolt snap fixture 50 being inserted therein along a bottom portion. The bolt snap 50 provides a wrap-around closure means to the apparatus 10 via attachment of the bolt snap 50 to one (1) of two (2) attachment rings 51. The attachment rings 51 are envisioned being a sewn-in metal fixture located at opposing corners along a lower edge of the aforementioned zippered pocket 23. The attachment rings 51 provide a reversing means allowing functional attachment when worn over a right or left shoulder.

Referring now to FIG. 2*b*, a rear perspective view of the apparatus 10, according to the preferred embodiment of the present invention, is disclosed. The apparatus 10 as shown here comprises a first zipper 24, and a second zipper 28.

The zippers 24, 28 are provided along opposing upper and lower edges of the zippered pocket 23 such that the zippered pocket 23 can be accessed through either zipper 24, 28 such as when the apparatus 10 is worn alternately over a left or right shoulder.

Referring now to FIG. 2*c*, a rear perspective view of the apparatus 10 depicting an inner pad material 22, according to an alternate embodiment of the present invention, is disclosed. The zippered pocket 23 is depicted here providing a large inner pad 22 along an inner surface directed toward the user's body 60 to stabilize the position of the invention 10 upon the user's torso 60. The inner pad 22 is envisioned being made using materials which provide added friction while increasing comfort such as, but not limited to air bladders, silicone gels, foam rubber panels, textured plastic, or the like.

Figure 3:
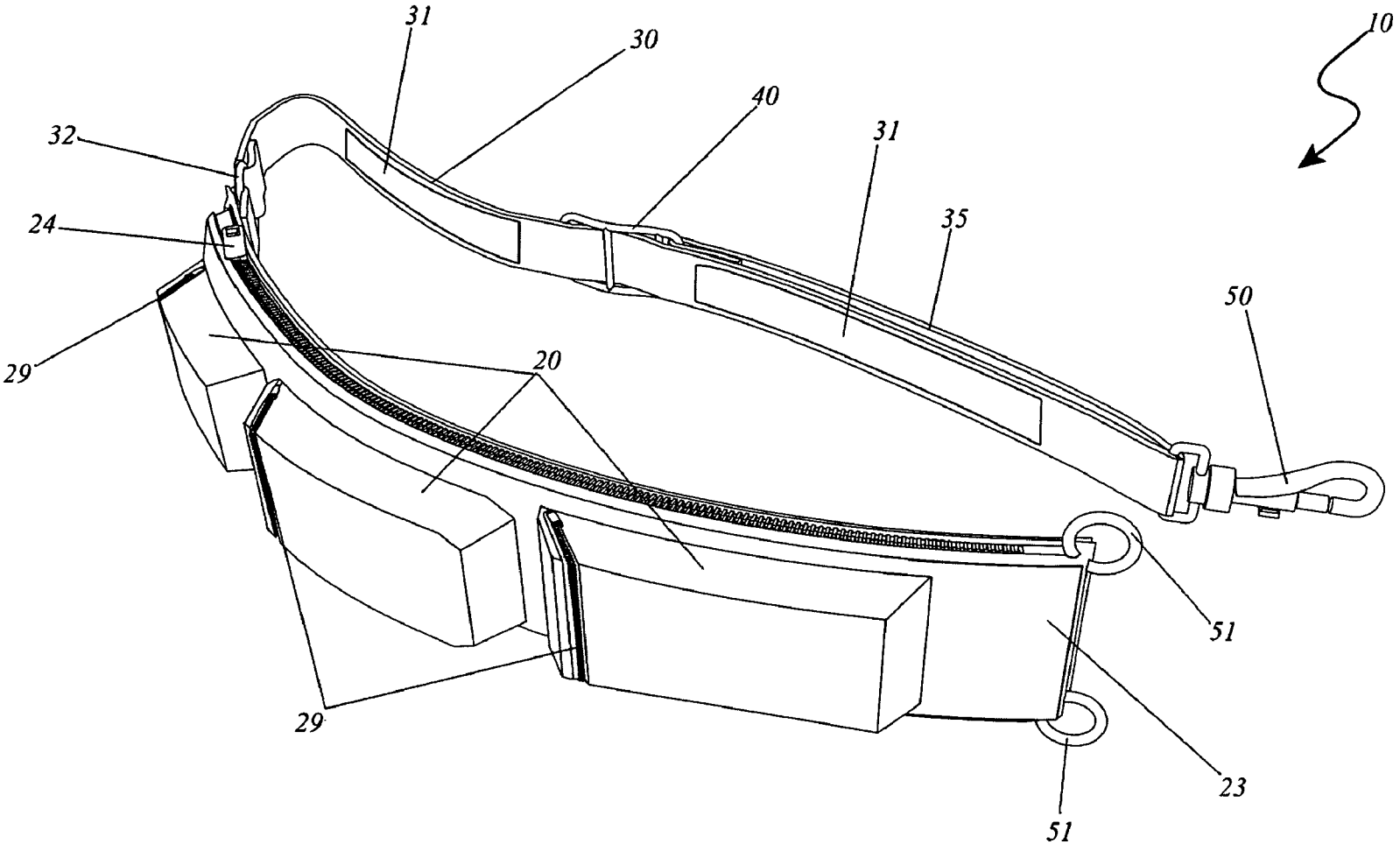

Referring now to FIG. 3, a front perspective view of the apparatus 10 depicting pouch zippers 29, according to an alternate embodiment of the present invention, is disclosed. The apparatus 10 comprises a plurality of pouch zippers 29. The use of the apparatus 10 equipped with pouch zippers 29 provides a water-resistant closure means to the pouches 20, thereby allowing use of the invention 10 when engaging in water sports such as kayaking, sailing, or the like, being especially beneficial to personal items which may be damaged by exposure to water.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user 60 in a simple and effortless manner with little or no training. After initial purchase or acquisition of the apparatus 10, it would be installed as indicated in FIG. 1.

The method of installing and utilizing the apparatus 10 may be achieved by performing the following steps: utilizing the reversible feature of the apparatus 10 by placing over the head and selectively over whichever arm the user 60 prefers, such that a section of the shoulder strap 30 rests on a shoulder and another section rests on the waist or hip on the opposite side of said shoulder such that the apparatus 10 is running diagonally across the chest and back of the user 60 from the shoulder to the hip; adjusting the shoulder strap 30 to a desired length using the adjustment fitting 40 to correspond to the user's 60 body size and shape; clipping the apparatus 10 thereto itself by interlocking the bolt snap portion 50 to the upward attachment ring portion 51 resulting from selection of the right or left orientation; opening any or all desired flaps 21 by unsnapping the magnetic fasteners 25, 26; placing desired personal articles in the pouches 20 such as a cell phone, a palm pilot, an MP3 player, a money clip, and the like; closing said pouches 20 by joining the magnetic fasteners 25, 26; unzipping the zippered pocket 23 by unzipping the upward facing zipper 24, 28; placing personal articles in the zippered pocket 23 such as a checkbook, a passport, airline tickets, and the like; closing said zippered pocket 23 by zipping the upward facing zipper 24, 28; removing and returning said personal articles therefrom pouches 20 and/or the zippered pocket 23 as needed during various activities; adjusting the adjustment fitting 40 and the shoulder strap 30 to lengthen said strap 30 loosely, thereby removing the apparatus 10 therefrom the user 60, when finished; taking the apparatus 10 over the head and one arm; and, storing accordingly.

The apparatus 10 is not only envisioned to being a new fashion accessory, but is also intended to provide easier access and increased comfort when compared to similar items being carried on a belt, about the waist, or in pockets. The apparatus 10 is to be worn stylishly and comfortably by men and women engaged in both athletic and non-athletic activities.

The apparatus 10 may be worn providing the pouches 20 being located on the front face for easy access or alternately, the apparatus 10 may be reversed such that the pouches 20 are facing the user's body 60, if desired. In either case, the apparatus 10 may be worn under a coat and/or other articles of clothing thereby increasing security and safekeeping.

Additionally, the apparatus 10 may be worn with equally beneficial utility in a variety of locations and orientations upon one's body 60 such as across the back area in a similar manner as the previously described chest orientation; around the waist in similar fashion as a utility or tool belt; over the shoulder; or over one's hip area.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A carrying case for storing and transporting objects, said carrying case comprising:

a zippered pocket;

a plurality of pouches attached to said pocket, each of said pouches including a corresponding flap pivotally attached thereto;

a shoulder strap attached thereto said pocket, said shoulder strap further having at least one strap pad located on an underside surface thereof;

a bolt snap fastener directly coupled to said shoulder strap;

a pivot ring directly coupled to said pocket and said shoulder strap; and, a plurality of attachment rings directly coupled to opposing front-facing corners of said pocket and removably attached to said bolt snap fastener;

wherein said zippered pocket includes:

first and second longitudinal sides oppositely extending along an entire longitudinal length of said zipper pocket, and, a latitudinal side intermediately extending between said first and second longitudinal sides and along an entire latitudinal length of said zipper pocket;

wherein said opposing front-facing corners extend along said first and second longitudinal sides as well as said latitudinal side respectively;

wherein a first one of said attachment rings is coupled to respective apertures located at each of said first longitudinal side and said latitudinal side of said zipper pocket; and, wherein a second one of said attachment rings is coupled to respective apertures located at each of said second longitudinal side and said latitudinal side of said zipper pocket.

2. The carrying case of claim 1, wherein said pocket comprises:

a storage chamber located along an internal back face of said carrying case, said pocket including a first zipper and a second zipper oppositely seated therefrom for allowing access to an interior portion of said pocket; and, said plurality of pouches attached to an outward facing surface of said pocket.

3. The carrying case of claim 1, wherein said pouches protrude outwardly along an external front face of said pocket, wherein a corresponding length of each of said pouches extends across an entire span of said pocket.

4. The carrying case of claim 1, wherein said adjustable shoulder strap is connected thereto a top edge of said pocket via said pivot ring, wherein said shoulder strap extends from said pocket and around a user torso, said shoulder strap being removably attachable to said bolt snap fastener and said attachment rings respectively.

5. The carrying case of claim 1, where each of said pouches further comprises:

a first magnetic fastener and a second magnetic fastener removably connected thereto, said flaps being monolithically formed with an upper sewn panel of said pouches;

wherein said second magnetic fastener is mounted within a central location of an outward panel of said pouch and oriented in a position corresponding to said first magnetic fastener located at a central location within an internal face of said flaps.

6. The carrying case of claim 1, wherein said shoulder strap further comprises:

an adjustment clip attached to a portion thereof, an adjustable loop portion of said shoulder strap being positional through said clip; and, said bolt snap fastener coupled to a distal end of said shoulder strap.

7. The carrying case of claim 1, wherein said attachment rings are attached to opposing corners of said pocket.

8. The carrying case of claim 1, wherein said first and second zippers are provided along opposing upper and lower edges of said pocket such that said pocket is accessible from said upper and lower edges thereof;

wherein said pocket further includes a frictional material situated along an inner surface thereof and engageable with a body of the user.

9. A carrying case for storing and transporting objects, said carrying case comprising:

a zippered pocket;

a plurality of pouches attached to said pocket;

a shoulder strap attached to said pocket, said shoulder strap further having at least one strap pad located on an underside surface thereof;

a bolt snap fastener directly coupled to said shoulder strap;

a pivot ring directly coupled to said pocket and said shoulder strap; and, a plurality of attachment rings directly coupled to opposing front-facing corners of said pocket and removably attached to said bolt snap fastener;

wherein said pocket comprises a storage chamber located along an internal back face of said carrying case, said pocket including a first zipper and a second zipper oppositely seated therefrom for allowing access to an interior portion of said pocket; and, said plurality of pouches attached to an outward facing surface of said pocket;

wherein each of said pouches further comprises a corresponding flap pivotally attached thereto;

a first fastener and a second fastener removably connected thereto, said flaps being monolithically formed with an upper sewn panel of said pouches;

wherein said second fastener is mounted to a central location along an outward panel of said pouch and oriented in a position corresponding to said first fastener located at a central location along an internal face of said flaps;

wherein each of said flaps is pivotal along a fulcrum axis oriented perpendicular to a longitudinal length of said first and second zippers;

wherein said zippered pocket includes:

first and second longitudinal sides oppositely extending along an entire longitudinal length of said zipper pocket, and, a latitudinal side intermediately extending between said first and second longitudinal sides and along an entire latitudinal length of said zipper pocket;

wherein said opposing front-facing corners extend along said first and second longitudinal sides as well as said latitudinal side respectively;

wherein a first one of said attachment rings is coupled to respective apertures located at each of said first longitudinal side and said latitudinal side of said zipper pocket; and, wherein a second one of said attachment rings is coupled to respective apertures located at each of said second longitudinal side and said latitudinal side of said zipper pocket.

10. The carrying case of claim 9, wherein said pouches protrude outwardly along an external front face of said pocket, wherein a corresponding length of each of said pouches extends across an entire span of said pocket.

11. The carrying case of claim 9, wherein said adjustable shoulder strap is permanently connected along a top edge of said pocket via said pivot ring, wherein said shoulder strap extends from said pocket and around a user torso, said shoulder strap being removably attachable to said bolt snap fastener and said attachment rings respectively.

12. The carrying case of claim 9, wherein said first fastener and second fastener are mutually connectable thereto each other and comprise snap-type fasteners, magnetic fasteners, hook-and-loop-type fasteners, or zippered fasteners.

13. The carrying case of claim 9, where each of said pouches is fabricated out of a waterproof and resilient material and further comprises:

a zippered fastener, wherein said zippered fastener is secured to an upper location horizontally along an outward panel of said pouch.

14. The carrying case of claim 9, wherein said shoulder strap further comprises:

an adjustment clip attached to a portion thereof, an adjustable loop portion of said shoulder strap being positional through said clip; and, said bolt snap fastener coupled to a distal end of said shoulder strap.

15. The carrying case of claim 9, wherein said attachment rings are attached to opposing corners of said pocket.

16. The carrying case of claim 9, wherein said first and second zippers are provided along opposing upper and lower edges of said pocket such that said pocket is accessible from said upper and lower edges thereof;

wherein said pocket further includes an frictional material situated along an inner surface thereof and engageable with a body of the user.

17. A method of transporting objects in a carrying case comprising the steps of:

a. placing said carrying case over a shoulder of the user such that a section of a shoulder strap of the carrying case having at least one strap pad located on an underside surface thereof rests on said shoulder and another section of said shoulder strap rests on an oppositely located hip portion of the user such that the carrying case diagonally extends across chest and back regions of the user;

b. adjusting the shoulder strap to a desired length by adapting an adjustment clip connected thereto;

c. interlocking a bolt snap portion of the shoulder strap to an upward attachment ring portion located on opposing front-facing corners of said carrying case;

d. opening at least one flap of a plurality of pouches connected to a pocket by disengaging first and second magnetic fasteners;

e. placing the objects in the pouches;

f. closing said pouches by engaging the first and second magnetic fasteners;

g. unzipping a pocket by adapting an upward facing zipper along a first path;

h. placing additional ones of the objects in the pocket; and, i. zipping the pocket by adapting the upward facing zipper along a second path traveling opposite to said first path;

wherein said zippered pocket includes:

first and second longitudinal sides oppositely extending along an entire longitudinal length of said zipper pocket, and, a latitudinal side intermediately extending between said first and second longitudinal sides and along an entire latitudinal length of said zipper pocket;

wherein said opposing front-facing corners extend along said first and second longitudinal sides as well as said latitudinal side respectively;

wherein a first one of said attachment rings coupled to respective apertures located at each of said first longitudinal side and said latitudinal side of said zipper pocket; and, wherein a second one of said attachment rings is coupled to respective apertures located at each of said second longitudinal side and said latitudinal side of said zipper pocket.

18. The method of claim 17, wherein further comprising the steps of:

j. supporting said carrying case in different orientations of the user;

k. removing the objects from at least one of the pouches and the pocket; and, l. adjusting an adjustment clip and the shoulder strap to lengthen the shoulder strap to a desired length.

* * * * *